United States Patent [19]

Guignard

[11] 4,230,650

[45] Oct. 28, 1980

[54] PROCESS FOR THE MANUFACTURE OF A PLURALITY OF FILAMENTS

[75] Inventor: Claude Guignard, St-Genis, France

[73] Assignee: Battelle Memorial Institute, Geneva, Switzerland

[21] Appl. No.: 768,422

[22] Filed: Feb. 14, 1977

Related U.S. Application Data

[63] Continuation of Ser. No. 495,544, Aug. 7, 1974, abandoned.

[30] Foreign Application Priority Data

| | | | |
|---|---|---|---|
| Aug. 16, 1973 | [CH] | Switzerland | 11793/73 |
| Nov. 6, 1973 | [CH] | Switzerland | 15592/73 |
| Dec. 12, 1973 | [CH] | Switzerland | 17380/73 |
| Jan. 28, 1974 | [JP] | Japan | 49/1082 |

[51] Int. Cl.[3] ..... B06B 1/02; B05C 5/02

[52] U.S. Cl. ..... 264/24; 156/62.4; 264/138; 264/164; 425/174.8 E; 427/32

[58] Field of Search ..... 264/24, 164, 138; 425/174.8 R, 174.8 E; 427/30–32; 156/62.4

[56] References Cited

U.S. PATENT DOCUMENTS

| | | | |
|---|---|---|---|
| 1,975,504 | 10/1934 | Formhals | 264/164 |
| 2,048,651 | 7/1936 | Norton | 264/24 |
| 2,336,745 | 12/1943 | Manning | 264/24 |
| 2,810,426 | 10/1957 | Till et al. | 264/24 |
| 3,280,229 | 10/1966 | Simons | 264/10 |
| 3,366,503 | 1/1968 | Dillhoefer et al. | 264/24 |
| 3,994,258 | 11/1976 | Simm | 264/10 |
| 4,043,331 | 8/1977 | Martin et al. | 264/22 |
| 4,069,026 | 1/1978 | Sium et al. | 264/22 |

FOREIGN PATENT DOCUMENTS

| | | | |
|---|---|---|---|
| 46-37769 | 11/1971 | Japan | 264/10 |
| 48-1466 | 1/1973 | Japan | 264/24 |

*Primary Examiner*—Jay H. Woo

*Attorney, Agent, or Firm*—Robert E. Burns; Emmanuel J. Lobato; Bruce L. Adams

[57] ABSTRACT

A method and apparatus for making filaments and a fibrous product of randomly overlying filaments in a mat configuration bonded to each other at areas of intersection. The filaments are formed by subjecting a travelling layer of a settable, dielectric, molten polymer material to an electrostatic field of lines of flux of sufficient density and intensity to flow from the layer of molten polymer a multiplicity of filaments which are partially set as they form. The filaments are subjected to the field along enough to separate them from the surface of the layer and are then collected randomly overlying each other in a tacky condition so that they bond to each other in areas of intersection. The method may include insertion of an object in the path of the separated filaments for collecting them on a surface of the object. The object can be rotated so that a package of the matter material is formed about it to protect it. The layer can be pretreated before subjection to the field to densify discrete areas to form on the surface thereof starting points for the filaments. The apparatus for carrying out the method comprises a travelling transport for the layer in the form of a belt permeable to the electrostatic field in which case two electrodes develop the field or the transport may be conductive to act as one of the electrodes developing the field. A collector for the matter material can be constituted as a travelling electrode in the form of a conductive belt which is grounded with a potential applied across the belt transports.

12 Claims, 14 Drawing Figures

FIG. 1
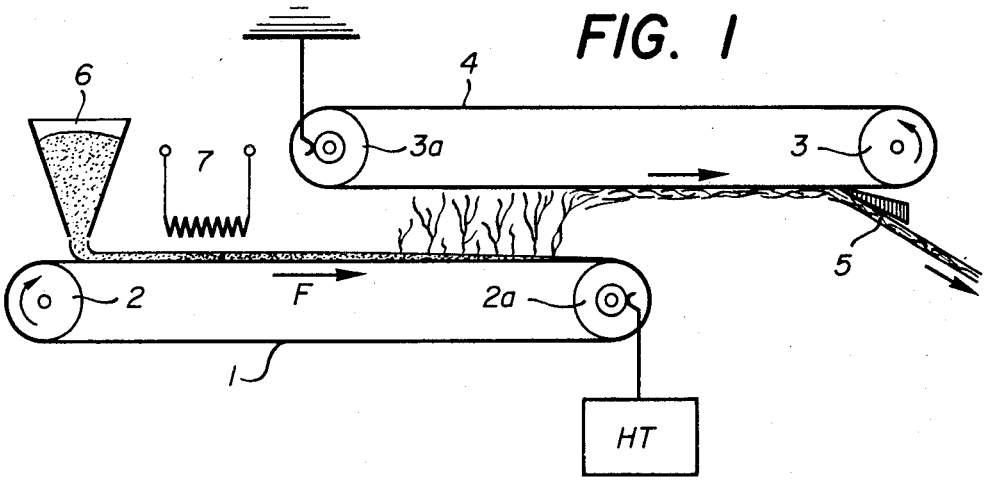
FIG. 4
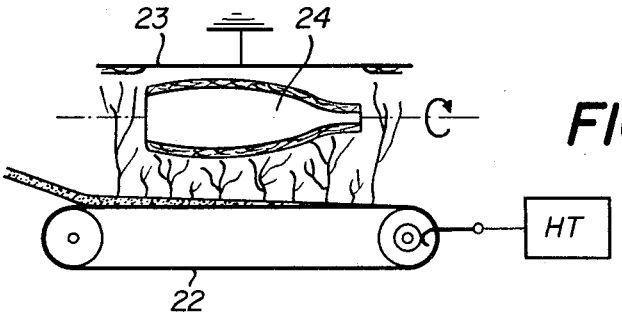
FIG. 5
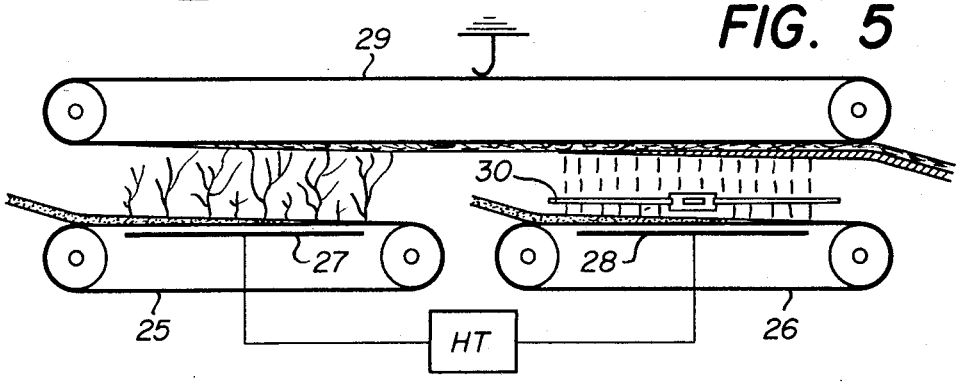
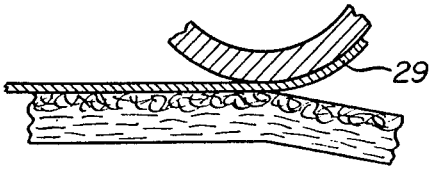
FIG. 6
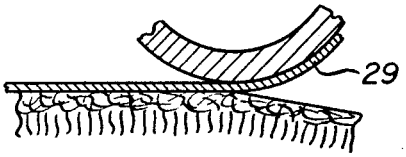
FIG. 7

FIG. 11
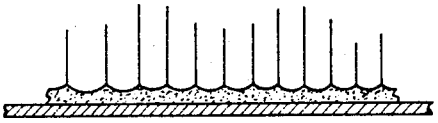
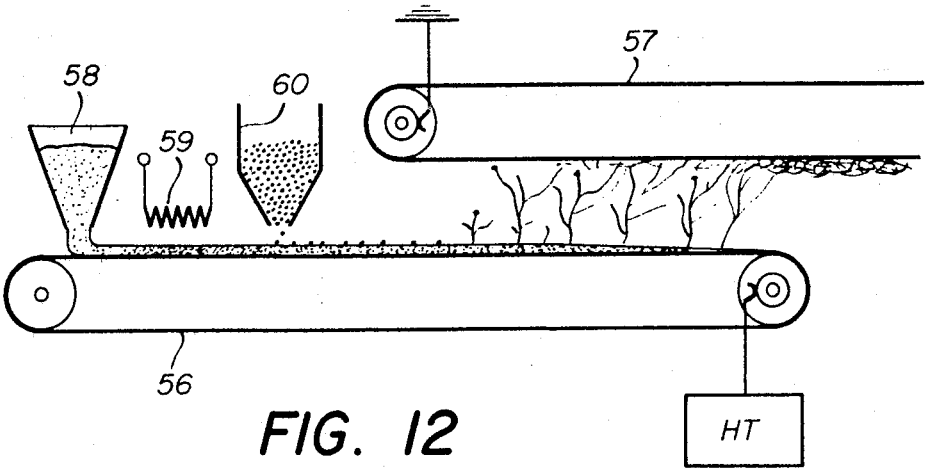
FIG. 12

1050 ×

2200 ×

PROCESS FOR THE MANUFACTURE OF A PLURALITY OF FILAMENTS

This is a continuation of application Ser. No. 495,544, filed Aug. 7, 1974 now abandoned.

BACKGROUND OF THE INVENTION

This invention relates generally to the formation of filament products and more particularly a method and apparatus for making filaments and fibrous products therefrom.

It has already been proposed - particularly in French Pat. No. 707 191, U.S. Pat. No. 1 975 504, and Swiss Pat. No. 537 205 to produce relatively short fibers by means of approximately 10% dielectric solutions, very small quantities of which are removed by means of a moving unit which extends partially into a stock of solution in order to wet its surface with the solution. This movable unit constitutes an electrode opposite which at least one counter electrode is arranged. By applying a difference in potential between the electrode and the counter electrode, the electric field developed produces, at the dielectric solution wetting the surface of the electrode, electrostatic forces which propel the liquid entrained out of the stock of solution by the emerging portion of the movable unit towards the counter electrode, forming small fibers. The action of the electrostatic field on the liquid causes a sort of atomization of the liquid.

It is furthermore known that in the case of French Pat. No. 707 191 and U.S. Pat. No. 1 975 504 the movable unit is formed of a toothed wheel, the fibers being started at the ends of the tips of the teeth due to the concentrations of the electrostatic field on these tips.

In Swiss Pat. No. 537 205, the movable unit consists of a ring of a diameter of 1 meter driven at a speed of rotation of 30 rpm corresponding to a speed of about 1.5 meters/second. Taking into account the fluidity of the solutions used, it can be thought that the centrifugal force contributes to the spraying of the liquid into the electric field created between the electrodes.

Moreover, the applications of these processes are very limited and raise numerous practical problems. These limits result from various factors. First of all, the material which can be used must be capable of being transformed into a solution.

The fact that a solution is used raises two contradictory problems. The solution must be sufficiently fluid in order that upon its transportation by the movable unit the solvent does not evaporate before the solution is brought into the electrical field. From the moment that the fiber detaches itself from the movable unit it is projected towards the counter electrode so that the distance between the electrodes must be sufficient to permit the solvent to evaporate in the space between the electrodes, as otherwise the fiber would again form a droplet upon contacting the counter electrode, which would be equivalent to a transportation of liquid from one electrode to the other. The large distance which must separate the electrodes results in the use of voltages of between 50 and 200 KV. These limits of the process extend also to the product obtained, which can be formed only of relatively short fibers.

It has already been proposed to produce by this method products having the appearance of a fabric as well as filters. However, in view of the length of the fibers and the fact that these fibers must be dried before coming into contact with each other, the coherence of the product is insufficient for the formation of a non-woven fabric.

SUMMARY OF THE INVENTION

An object of the present invention is to remedy—at least in part—the drawbacks of the said solutions so as to be able to produce filaments and not be subject to the limitations encountered with the known processes.

For this purpose, the object of the present invention is a process for the manufacture of filaments from a heat-fusable material characterized by forming on the surface of a substrate, a layer of a molten dielectric material whose viscosity is between a Meltindex of 20 and 200 and subjecting the material covering the substrate to the action of an electrostatic field whose lines of force extend substantially perpendicular to the surface of this substrate, all in such manner that, under the action of this field, a plurality of agglutinated groups of molecules is torn away from said material and said material is stretched, upon cooling it, along these lines of force in order to form a plurality of filaments.

The viscosity of the material used makes it possible to draw filaments from a layer of material which forms, on the surface of the substrate, a sort of stock of material of sufficient volume to form filaments of several meters. It is the presence of this stock as well as the operation with materials in visco-elastic condition which makes it possible to obtain filaments. Furthermore, even if these filaments should touch each other before they are dry, they retain their appearance while fusing together locally, which is not possible with fibers coming from a solution.

BRIEF DESCRIPTION OF THE DRAWINGS

The accompanying drawing shows, very schematically and by way of example, several embodiments of the carrying out of the process forming the object of the present invention, as well as various products obtained with the filaments thus obtained.

FIG. 1 is a side elevation view of one embodiment of an installation illustrating one of the methods of carrying out the process in accordance with the invention.

FIG. 4 is a side elevation view of a variant of FIG. 1.

FIG. 5 is a side elevation view of another embodiment of an installation, illustrating another variant for the carrying out of the process of FIG. 1.

FIGS. 6 and 7 are fragmentary detailed views on a larger scale of two products obtained by means of the installation of FIG. 5.

FIG. 11 is an elevation view of a product obtained in accordance with a variant of the method of FIG. 8.

FIG. 12 is an elevation view illustrating a variant manner of procedure applicable to one of the preceding embodiments.

DESCRIPTION OF THE PREFERRED EMBODIMENTS

Figure 2:
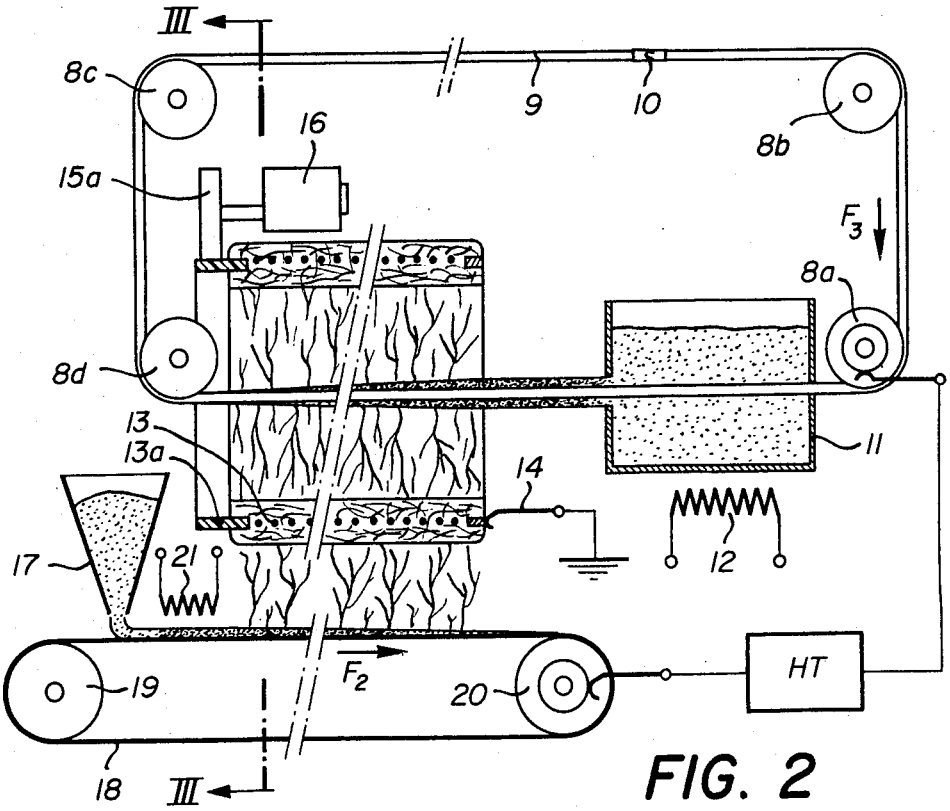
FIG. 2 is a side elevation view partly in section of another embodiment of an installation, showing a variant of the method of carrying out the invention shown in FIG. 1.
Figure 3:
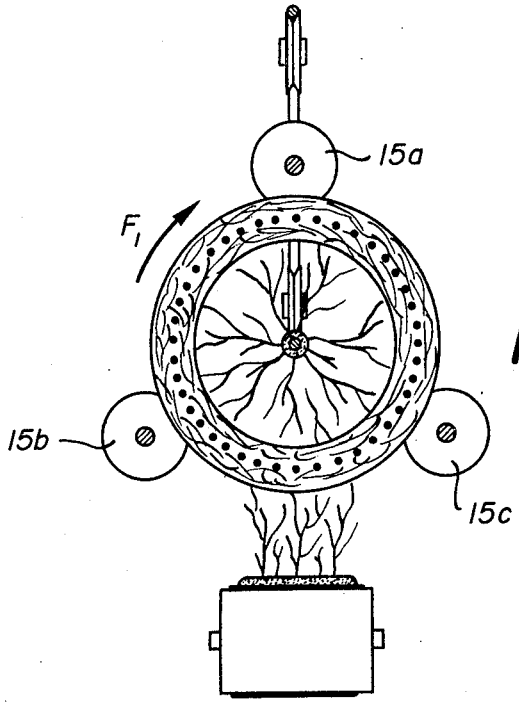
FIG. 3 is a cross section view adjacent an end view of the apparatus in FIG. 2.

The principle employed by the method forming the object of the invention which will be described is based on the electrostatic forces which are produced by an electrostatic field formed between two electrodes, one of which is fed by a high voltage generator while the other is grounded. This principle, which in itself is known, has already been used for powdering or flocking. This principle has also been employed to form a layer of a non-woven product by electrically charging threads so that the electric charges which they carry cause them to repel each other before they are collected on a support.

In the case of the present invention, a thermoplastic dielectric material is melted on a substrate and this melted material is charged electrically by bringing it to the potential of the feed electrode fed by a high voltage current. By placing a grounded electrode opposite the feed electrode, the molten material tends to follow the lines of force of the electrostatic field thus created. Groups of agglutinated molecules are torn off from the mass of molten material and propelled towards the other electrode, stretching the material as these agglutinated molecules move away from the feed electrode. In principle the length of the filament is limited only by the stock of material is formed by the molten layer. Of course these filaments may break at random, but in this case the broken end attached to the layer of material immediately again forms another filament until the layer of material has been exhausted.

A particularly interesting phenomenon takes place with an entire range of materials whose viscosity is between a Meltindex of 70 and 200 in accordance with American Standard Test Method B 1238-74 P (ASTM) or British Standard 2782-Part 1-105 C 1956 (BS). As a matter of fact, within this viscosity range, the stretched filaments branch out under the effect of the electrostatic field as they are stretched, forming arborescent filaments composed of a main filament and of secondary filaments which are finer than the main filament. This filament structure is of particular interest for the production of non-woven products which are finding ever-increasing use. One of the problems of non-woven products consists in producing a product of uniform opacity. Now, with the methods of manufacture employed this uniformity is very difficult to obtain. The arborescent structure of the filaments and the difference in fineness between principal and secondary filaments makes the non-woven product obtained more homogeneous.

Another problem of these products consists in imparting sufficient coherence to them. This is why the filaments are frequently bonded to each other. The use of the process of the invention makes it possible to solve this problem more simply. The filaments being drawn from the mass of molten material, it is sufficient to fix the distance between the substrate bearing the layer of molten material and the substrate collecting the filaments in such a manner that the filaments have not yet completely cooled upon arriving on the receiving substrate. Upon coming into contact with each other these filaments fuse together locally.

Aside from the viscosity range indicated, within which the molten material is stretched in the form of arborescent filaments by the electrostatic field, monofilaments of a Meltindex of between 20 and 70 are produced (in accordance with the same standards as mentioned above). One interesting application of the monofilaments thus produced will be described below.

The first installation for the carrying out of this process is shown in FIG. 1. It comprises a first metal conveyor belt 1 mounted on two driven rollers 2 and 2*a* one of which, 2*a*, is connected to a source of high voltage HT. A second metal conveyor belt 4 is mounted on two driven rollers 3 and 3*a*, one of which, 3*a*, is grounded. These two conveyor belts, 1 and 4, have two respective runs parallel to each other but are staggered longitudinally. A hopper 6 delivers powdered thermoplastic material to one end of the upper run of the conveyor belt 1. A heating body 7 connected to a source of current (not shown) is arranged downstream the hopper 6 as referred to the direction of advance of the belt 1 indicated by the arrow F. The two belts 1 and 4 are driven by a mechanism (not shown) so that the adjacent runs thereof travel in a same direction, toward the right in FIG. 1.

The thermoplastic material discharged by the hopper melts upon passing below the heating body 7 and forms a viscous layer. The temperature is selected as a function of the thermoplastic material used and should be substantially greater than the melting point of said material. This molten material penetrates into the electrostatic field created between the two portions of the belts 1 and 4 which are located opposite each other due to the difference in potential applied to these two belts.

As the molten thermoplastic material penetrates into this electrostatic field, the forces produced by the attraction exerted on this material, brought to the potential of the belt 1, by the grounded belt 4 detach groups of molecules and stretch the material towards the belt 4 which collects the filaments in the form of a non-woven product 5. In FIG. 1 it will be noted that the thermoplastic material has been selected in such a manner that the filaments form arborescences, under the conditions which we have explained above.

The speed of each belt 1 and 4 is selected, in the case of the belt 1, in such a manner that the layer of material is renewed uninterruptedly and in the case of the belt 4 as a function of the thickness of the layer of unwoven material 5 desired. As can be seen, the layer of thermoplastic material gradually decreases and the speed of the belt 1 must be selected so that practically the entire layer of material has disappeared from this belt upon emergence from the electrostatic field.

The distance between the electrodes may vary as a function of the nature of the material, as well as as a function of the stage of cooling at which it is desired to collect the filaments. As indicated previously, it may be very advantageous to collect the filaments while they are still tacky so that they fuse together locally.

By way of example, non-woven products of a thickness of 1 mm consisting of arborescent filaments fused to each other have been formed by means of two electrodes spaced 20 mm apart. The feed electrode, that is to say the belt 1, was fed with a generator supplying a current of 10 kV of an intensity of 100 μA, while the receiving electrode was gounded. The materials used were thermoplastic materials having a viscosity of a Meltindex of between 70 and 200.

The installation in accordance with the second embodiment is intended for the production of seamless tubular elements, for instance filter elements.

This installation comprises four guide pulleys 8*a*, 8*b*, and 8*c*, and 8*d* arranged in a rectangle, around which there is stretched a wire 9 whose two ends are releasably hooked to each other by means of a suitable system of hooking 10. This wire 9 which is driven in the direction of the arrow $F_3$ by the drive pulley 8*b* passes through a tank of thermoplastic material 11 heated by a resistor 12 and then passes axially into a tubular body 13 formed of a metal grid connected to ground by a brush 14 and guided, by means of an insulating ring 13*a*, in this example of plastic, which is molded to one end of the grid 13, by three rollers 15*a*, 15*b* and 15*c*, the roller 15*a* being driven by a motor 16 in order to impart the body 13 rotation in the direction indicated by the arrow $F_1$.

A hopper 17 discharges powdered thermoplastic material on a metal belt 18 which is stretched between two pulleys 19 and 20 one of which, 19, is driven, while the other is connected to a source of high voltage current HT which also feeds the pulley 8*a*. This metal belt extends below the tubular body 13. A heating element 21 located at the outlet of the hopper 17 above the belt 18 melts the thermoplastic material as the belt advances in the direction indicated by the arrow $F_2$.

The difference in potential between the tubular body 13 and the electrodes formed by the substrates 9 and 18 corresponding respectively to the wire and the belt connected to the source of high voltage HT creates two electrostatic fields, one radial between the wire 9 and the tubular body 13 and the other outside said tubular body so that two layers of non-woven material are formed on the inner and outer faces respectively of the body 13.

As a variant, one can contemplate producing only one of the two layers of non-woven material either on the inside or on the outside of the tubular body 13, the latter being then formed of a solid-wall tube. The non-woven product thus obtained is then detached from the substrate formed by this tube which may, for this purpose, be formed of two semi-cylindrical portions.

The variant of FIG. 4 shows how one can, by this process, surround a non-conductive body of revolution, for instance, in order to provide a protective envelope around the object so as to protect it during its transportation.

For this purpose an electrode 23 which in this case may be stationary, is placed opposite a metal belt 22 fed by a source of high voltage HT. The non-conductive object 24 to be wrapped, in this example a bottle, is mounted for rotation around an axis parallel to the belt 22. The thermoplastic material is previously melted and poured onto the belt 22. The electrostatic field created between the belt 22 and the grounded electrode 23, as a result of the difference in potential, again causes the formation of filaments which are in part intercepted by the rotating object 24 located in this field.

As a variant, an object of conductive material may be wrapped by grinding it itself.

FIG. 5 shows an installation for the production of another type of material. This installation comprises two endless belts 25 and 26 forming two loops located in position as extensions of each other. Two stationary electrodes 27 and 28 are placed under the upper runs respectively of these loops and are connected to a source of high voltage HT. A third belt 29 of metal extends parallel above the other two and is grounded.

A filament cutting member 30 is placed between the belt 26 and the belt 29. The belt is fed with a previously melted thermoplastic material of a viscosity of a Meltindex of between 70 and 200, while the belt 26 is fed with a previously melted thermoplastic material of a viscosity between a Meltindex of 20 and 70. The electrostatic field created between the belt 29 and the electrodes 27 and 28 first of all creates arborescent fibers which, once collected by the belt 29, form a non-woven product. The same field produces monofilaments from the molten material discharged onto the belt 26 due to the higher viscosity of the product. The cutting member 30 divides these filaments into fibers.

By this means there is obtained (FIG. 7) a band of a filamentary product composed of a non-woven support from the molten material deposited on the belt 25 and of a layer, formed of fibers produced from the molten material deposited on the second belt 26. These fibers are needled into the non-woven fabric, which imparts a velvety texture to the product obtained, the properties and appearance of which may differ greatly in accordance with the nature and color of the products selected. It is also possible to provide an additional operation, for instance a calendering in order to flatten the short fibers, in order to form a product recalling the appearance of felt (FIG. 6). By means of this same process can be obtained by forming a first non-woven layer from molten polyethylene on the belt 25 and incorporating cellulose fibers in said non-woven layer either by flocking or from a solution of cellulose. The product obtained is then subjected to a calendering operation in order to obtain a product capable of replacing paper and having the advantage of effecting a substantial saving of wood.

Figure 8:
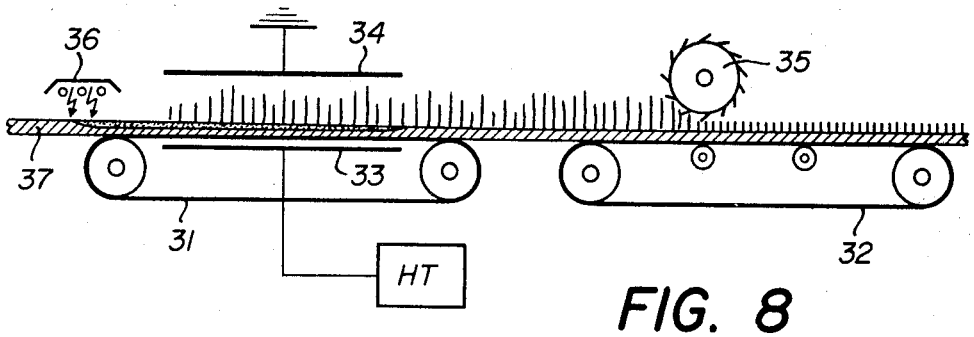
FIG. 8 is a side elevation view of an embodiment of an installation illustrating another method of carrying out the process of the invention.

FIG. 8 illustrates another manner of carrying out the process of the invention. For this purpose the installation shown comprises two belts 31 and 32 forming two loops, arranged as extensions of each other. The upper run of the first belt 31 passes over a fixed electrode 33 connected to a high voltage generator HT. This electrode 33 is located opposite a second grounded electrode 34 placed above the upper run of the belt 31.

A cutting device 35 is placed above the upper strand of the second belt 32 while a heating body 36 is placed above the first belt 31, upstream of the electrodes 33 and 34 as seen in the direction of advance of the product produced which advances from left to right.

The thermoplastic material used in this application is fed in the form of a strip 37 which is melted on its surface by passing below the heating body 36. As soon as the strip arrives in the electrostatic field created between the electrodes 33 and 34 filaments are formed under the action of this field and are drawn in the direction of the electrode 34. As in this application it is desired that the filaments remain attached to the strip 37 it is necessary to interrupt their elongation before they touch the electrode 34. For this purpose cooling means can be employed, for instance a stream of cooling air. The cutting device 35, which is optional, serves to reduce all the hairs or fibers to the same length. It is also possible not to cut them, so that the product resembles fur. The monofilaments obtained by electrostatic drawing have the important characteristic of forming a very elongated cone corresponding to this to animal hair so that this embodiment of the process lends itself particularly well to the manufacture of imitation fur.

Figure 9:
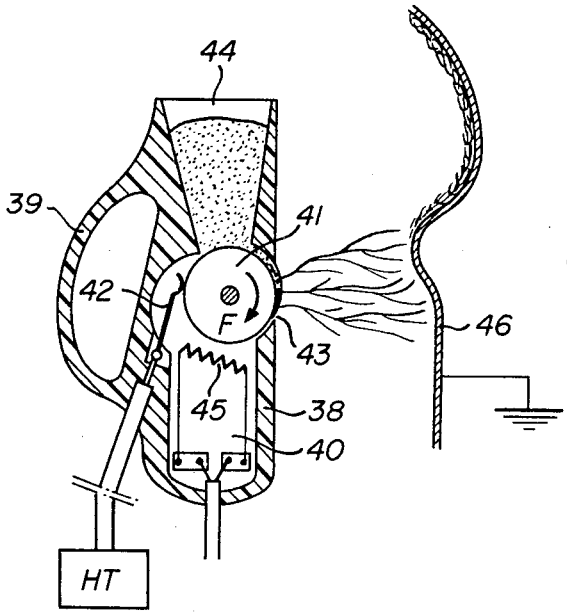
FIG. 9 is an elevation view in section of a portable apparatus for the carrying out of the embodiment of FIG. 1.

The apparatus represented in FIG. 9 is a portable apparatus for forming a covering of non-woven product in situ. A housing 38 of this apparatus, which is provided with a handle 39, contains a chamber 40 in which there is located a conductive roller 41 which is driven by means (not shown) in the direction indicated by the arrow F and which is connected to a high voltage generator HT by a brush 42. This roller 41 is arranged opposite an opening 43 which passes through the housing 38 opposite the handle 39. The chamber 40 communicates with the base of a hopper 44 through which the roller 41 extends. A heating element 45 serves to raise the temperature of the roller sufficiently in order that the granules of thermoplastic material charged into the hopper 44 melt in contact with said roller 41 and thus form a layer of viscous plastic material brought to the outside of the housing 38 by the rotation of the roller 41 in the direction indicated by the arrow F.

As the roller is fed with a negative voltage while object 46 to be covered is grounded, an electrostatic field is created between the roller 41 and the object 46 so that filaments are drawn from the layer of molten material formed on the surface of the roller 41. These filaments, which are arborescent due to the viscosity of the plastic material selected, form a non-woven covering on the surface of the object 46, the thickness of which depends on the speed with which the apparatus is moved.

Before continuing the description of another embodiment of the process of the invention it is necessary to point out that in order to remove material locally from a layer of more or less viscous material spread on a flat support it is necessary to produce concentrations of the electrostatic field. It is as a matter of fact the difference in force exerted by these concentrations of the field from the zones surrounding these concentrations which produces the detachment of groups of molecules at the points of these concentrations. Any irregularity formed on the surface of the layer of viscous material causes a concentration of the electrostatic field. Therefore the object of the embodiments which we will now describe consists in creating field concentrations and in particular in controlling the density of filaments which it is desired to obtain, and even to a certain extent the size of these filaments.

Figure 10:
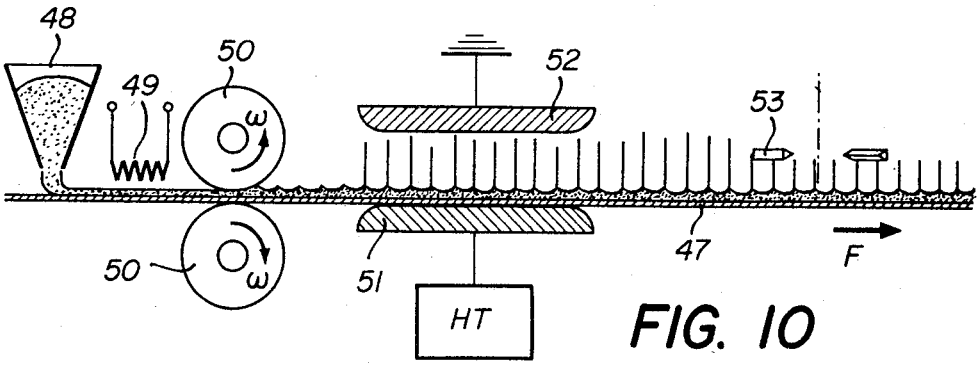
FIG. 10 is an elevation view of an installation illustrating a variant of the method applicable to any of the other preceding embodiments.

For this purpose, the installation illustrated in FIG. 10 shows a simple and effective means of forming startings of filaments on the surface of the molten thermoplastic material.

This installation comprises a driven conveyor belt 47, a feed hopper 48 for supplying thermoplastic material as granules or powder, a heater 49, a pair of rollers 50 arranged on opposite sides of the belt 47 and whose axes of rotation are transverse to the direction of advance of the belt, two electrodes 51 and 52 connected to a high voltage generator and ground respectively and finally—optionally—a cutting device 53.

The thermoplastic material is melted by the heater 49 and then passes between the two rollers 50 one of which supports the belt 47 while the other contacts the surface of the layer of molten material. These two rollers are driven (by means not shown in the drawing) at a speed in the direction indicated by the arrows in such a manner that the adherence between the molten material and the roller which contacts its surface forms a plurality of rough points.

Upon continuing its advance in the direction indicated by the arrow F, the belt 47 penetrates into the electrostatic field created between the electrodes 51 and 52 so that a filament extends from each rough point.

In the example illustrated it is assumed that one produces a product such as artificial fur by interrupting the formation of filaments by a sudden cooling of the filaments during the course of drawing. However, this manner of initiation is not reserved exclusively to the manufacture of such a product and can be used profitably for the manufacture of an unwoven product such as obtained by means of the embodiment of FIG. 1, for instance.

FIG. 11 shows a hairy product the free ends of the hairs of which form an undulation which results from a variation in the intensity of the field.

FIG. 12 illustrates another embodiment intended to obtain a concentration of the electrostatic field. For this purpose, this installation again comprises two endless metal belts 56 and 57 forming two elongated loops with parallel runs. A hopper 58 feeds the upper run of the lower belt 56 with powdered thermoplastic material. A heater 59 located behind the hopper 58 melts this thermoplastic material. A second hopper 60 is located behind the heater 59 and has the object of spreading onto the layer of molten material grains of powder of a particle size which is determined as a function of the desired fineness of the filaments and with a density per unit of surface established as a function of the density of hairs which it is desired to obtain. These grains of powder do not have time to melt completely so that they bond themselves to the molten material while forming on the surface of the layer rough points which result in concentrations of the electrostatic field. These grains of powder therefore act as filament initiators.

One can furthermore contemplate still other means of creating such filament initiators. One can for instance subject the molten material to suitable frequency vibrations.

It should be noted also that the nature of the receiving ribbon which constitutes the substrate on which the filaments are amassed is of a certain importance with respect to the appearance of the filamentary product obtained. Thus when using a receiving substrate formed of a wire gauze, one obtains a filamentary product which has a "gauze" appearance reproducing the structure of the receiving substrate. By varying the structure of this receiving substrate, for instance by drawing designs therein by means of threads, plates, pastilles etc. placed on its surface or even perforations, one can obtain a filamentary product reproducing all or part of these designs.

Figure 13:
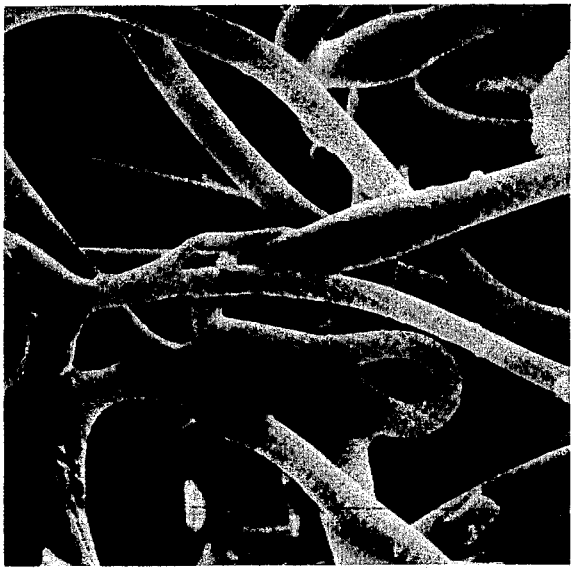
FIGS. 13 and 14 are photographs with an enlargement of 1050× and 2200× respectively, of the product obtained by the method of FIG. 1.
Figure 14:
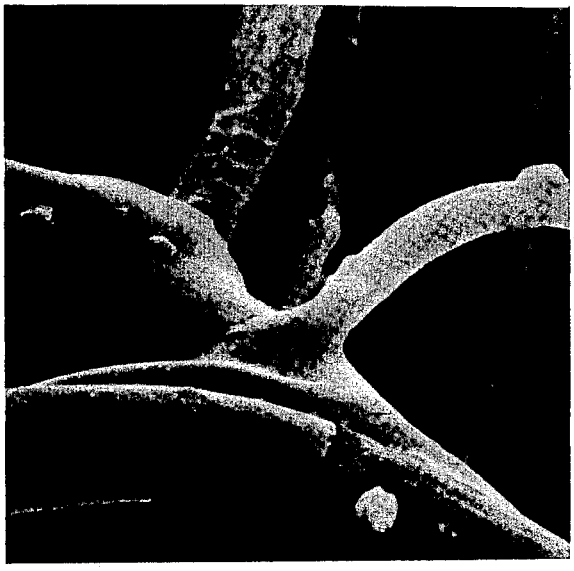

The photographs of FIGS. 13 and 14 are enlargements of 1050× and 2200× respectively of a non-woven product obtained by the process in accordance with the invention. The photograph of FIG. 13 clearly shows the intermingling of the filaments as well as the fusions produced between the filaments. There can also be noted the branchings as well as the differences in fineness between the different filaments. These latter features appear even more clearly from the photograph of FIG. 14 in which there can be seen particularly clearly a principal filament giving rise to several much finer secondary filaments.

The range of dielectric thermoplastic products in molten state which can be used is limited in practice only by the viscosity of these products depending on whether it is desired to obtain arborescent filaments as in practically all the non-wovens or monofilaments, essentially in the event that these filaments remain attached to the mass of material from which they are drawn. Among these products mention may be made of polyamides (nylons), polyethylene, vinyl polychlorides, acrylic resins, polystyrenes, polyurethanes, etc., but one can also use products such as tar and sugar.

The possibilities for the use of the products obtained are very vast and a few may be cited without this enumeration being exhaustive; floor and wall coverings; packaging; carpet; interior decoration; furnishings, upholstering; lining of automobile bodies; heat and/or accoustic insulation; electrical insulation; the foundation of roads (sublayer preventing the rising of clay); clothing and artificial fur; artificial leather; confectionery (filamentary products of chocolate, sugar etc.), feed (spinning of artificial proteins), filtration, stationery (particularly in the example of FIG. 6 described above).

The drawing of the filaments in an electrostatic field makes it possible to reach diameters of the order of a micron, which is a particularly important feature in the field of artificial leathers. Such a fineness of the filaments obtained is also important in order to improve the opacity of the non-wovens which may be made in smaller thicknesses for a given visual effect, substantially decreasing their price as compared with that of the similar products obtained by other processes.

I claim:

1. A process for the manufacture of a plurality of polymer fibers comprising, forming a continuous layer of dielectric molten polymer is a mass having a broad exposed surface from which polymer fibers are to be electrostatically developed and electrostatically directly torn therefrom, developing an electrostatic field between a first electrode and a second electrode spaced from the first electrode, the field consisting of lines of flux passing through a space between the two electrodes, and the first electrode being at a higher potential than the second electrode, while in a plastic consistency of a viscosity such that it can be directly electrostatically drawn from said layer into fibers subjecting said molten polymer to said electrostatic field without flow of said layer so that the lines of flux pass through said layer and are substantially perpendicular to said broad surface of the molten polymer, and maintaining said electrostatic field at an intensity effective to concentrate molten polymer molecules at discrete zones on said surface and agglutinate in said zones and are torn away due to the effect of said electrostatic field at said discrete zones from said exposed surface toward said second electrode along the lines of flux as molten polymer fibers that start to solidify and set during movement toward said second electrode.

2. A process for the manufacture of a plurality of polymer fibers according to claim 1, in which said fibers are tacky and some of which intersect and bond locally to each other at intersections thereof.

3. A process for the manufacture of a plurality of polymer fibers according to claim 1, in which said first electrode is a substrate and said layer of molten polymer is supported thereon.

4. A process for the manufacture of a plurality of polymer fibers according to claim 3, in which said first electrode and second electrode are subjected to relative movement to stretch said fibers while being developed extending along said lines of flux.

5. A process for the manufacture of a plurality of polymer fibers according to claim 1, in which said first electrode is a substrate and said layer of molten polymer is supported, and said polymer being heated to a molten state on said substrate.

6. A process for the manufacture of a plurality of polymer fibers according to claim 1, including cooling said fibers while the fibers are still attached to the layer.

7. A process for the manufacture of a plurality of polymer fibers according to claim 1, including collecting the fibers on said second electrode as a non-woven filamentary product.

8. A process for the manufacture of a plurality of polymer fibers according to claim 1, including cooling said fibers and said layer of molten polymer while said fibers are still attached to said layer.

9. A process for the manufacture of a plurality of polymer fibers according to claim 1, including solidifying the molten polymer and fibers while said fibers are still attached to said layer.

10. A process for the manufacture of a plurality of fibers according to claim 1, including disposing an object in said electrostatic field in the path of said fibers and collecting said fibers in a mat configuration on a surface of said object.

11. A process for the manufacture of a plurality of fibers according to claim 10, in which said object is rotated in the path of said fibers to thereby collect said fibers peripherally of said object and thereby package it in a mat of said fibers.

12. A process for the manufacture of plurality of fibers according to claim 1, including imparting relative movement between the first electrode and second electrode and collecting said fibers on said second electrode while moving away from said first electrode.

* * * * *

UNITED STATES PATENT AND TRADEMARK OFFICE

CERTIFICATE OF CORRECTION

PATENT NO. : 4,230,650

DATED : October 28, 1980

INVENTOR(S) : GUIGNARD

It is certified that error appears in the above-identified patent and that said Letters Patent are hereby corrected as shown below:

ON THE TITLE PAGE, UNDER

" FOREIGN APPLICATION PRIORITY DATA ", please DELETE

"JAN. 28, 1974 [JP] JAPAN.....49/1082"

and INSERT INSTEAD:

--JAN. 28, 1974 [CH] SWITZERLAND.....1082/74--.

Signed and Sealed this

*Eleventh* Day of *May 1982*

[SEAL]

*Attest:*

GERALD J. MOSSINGHOFF

*Attesting Officer*

*Commissioner of Patents and Trademarks*